US007077267B2

(12) United States Patent
Lee

(10) Patent No.: US 7,077,267 B2
(45) Date of Patent: Jul. 18, 2006

(54) TOOLBOX

(76) Inventor: Pei-Ling Lee, No. 12, Pei Feng Road, Szu Te Village, Wu Feng Hsiang, Taichung Hsien (TW)

( * ) Notice: Subject to any disclaimer, the term of this patent is extended or adjusted under 35 U.S.C. 154(b) by 0 days.

(21) Appl. No.: 10/996,221

(22) Filed: Nov. 23, 2004

(65) Prior Publication Data

US 2006/0108245 A1 May 25, 2006

(51) Int. Cl.
*B65D 85/28* (2006.01)

(52) U.S. Cl. ..... 206/373; 206/372

(58) Field of Classification Search ..... 206/349, 206/372–379, 315.11; 211/70.6; 312/271–272
See application file for complete search history.

(56) References Cited

U.S. PATENT DOCUMENTS 2,124,071 A * 7/1938 Loftin ..... 206/372
2,131,408 A * 9/1938 Murrer ..... 206/315.11
2,347,270 A * 4/1944 Larsson ..... 206/373
3,600,840 A * 8/1971 Meyer ..... 206/373
3,612,635 A * 10/1971 Uyeda et al. ..... 312/272
3,713,529 A * 1/1973 Meksula ..... 206/373
6,840,376 B1 * 1/2005 Chen ..... 206/373
2004/0168941 A1 9/2004 Cho ..... 206/373

* cited by examiner

*Primary Examiner*—Luan K. Bui
(74) *Attorney, Agent, or Firm*—Alan D. Kamrath; Nikolai & Mersereau, P.A.

(57) ABSTRACT

A toolbox includes a base, at least one tray, two links and at least one cover. The base includes at least one restraint formed on each of two opposite sides. The tray includes a restraint formed on each of two opposite sides. The links are pivotally connected with the tray at an end and pivotally connected with the base at an opposite end. The links abut the restraints in order to keep the tray lifted as the toolbox is opened. The tray does not shield the base as it is lifted. The cover is pivotally connected with the base. The cover does not shield the tray as the toolbox is opened.

7 Claims, 11 Drawing Sheets

TOOLBOX

BACKGROUND OF INVENTION

1. Field of Invention

The present invention relates to a toolbox.

2. Related Prior Art

US Patent Application Publication 2004/0168941 A1 discloses a conventional toolbox including a base 10 with an open top, two lower boxes 20 each with an open top, two upper boxes 20 each with an open top, a cover 40 pivotally connected with each upper box 20, a handle 30 pivotally connected with each cover 40 and a set of links 50 for connecting each side of the base 10, a related lower box 20 and a related upper box 20 with one another. A few problems are encountered in use of this conventional toolbox. Firstly, the links 50 are always exposed and can conveniently be hit and deformed so that the toolbox cannot be opened smoothly. Secondly, as the toolbox is opened, the base 10 is partially shielded by the lower boxes 20. Each lower box 20 is partially shielded by a related upper box 20. It is difficult to take tools or parts from these shielded portions. Thirdly, as the toolbox is opened, it looks like a seesaw. If tools and parts in the boxes 20 on a side are much heavier than tools and parts in the boxes 20 on the other side, the toolbox tumbles and some tools and parts fall from the toolbox.

The present invention is therefore intended to obviate or at least alleviate the problems encountered in the prior art.

SUMMARY OF INVENTION

According to the present invention, a toolbox includes a base, at least one tray, two links and at least one cover. The base includes at least one restraint formed on each of two opposite sides. The tray includes a restraint formed on each of two opposite sides. The links are pivotally connected with the tray at an end and pivotally connected with the base at an opposite end. The links abut the restraints in order to keep the tray lifted as the toolbox is opened. The tray does not shield the base as it is lifted. The cover is pivotally connected with the base. The cover does not shield the tray as the toolbox is opened.

The primary advantage of the toolbox of the present invention is that the links are put in the toolbox as the toolbox is closed. The links are protected. Smooth operation of the links is ensured.

Another advantage of the toolbox of the present invention is that the trays do not shield the base as the toolbox is completely open. Tools and parts can conveniently be put onto and taken from the base.

Another advantage of the toolbox of the present invention is that the covers do not shield the trays as the toolbox is completely open. Tools and parts can conveniently be put onto and taken from the trays.

Other objects, advantages and novel features of the invention will become more apparent from the following detailed description in conjunction with the attached drawings.

BRIEF DESCRIPTION OF DRAWINGS

The present invention will be described via detailed illustration of two embodiments referring to the drawings.

DETAILED DESCRIPTION OF EMBODIMENTS

Figure 1:
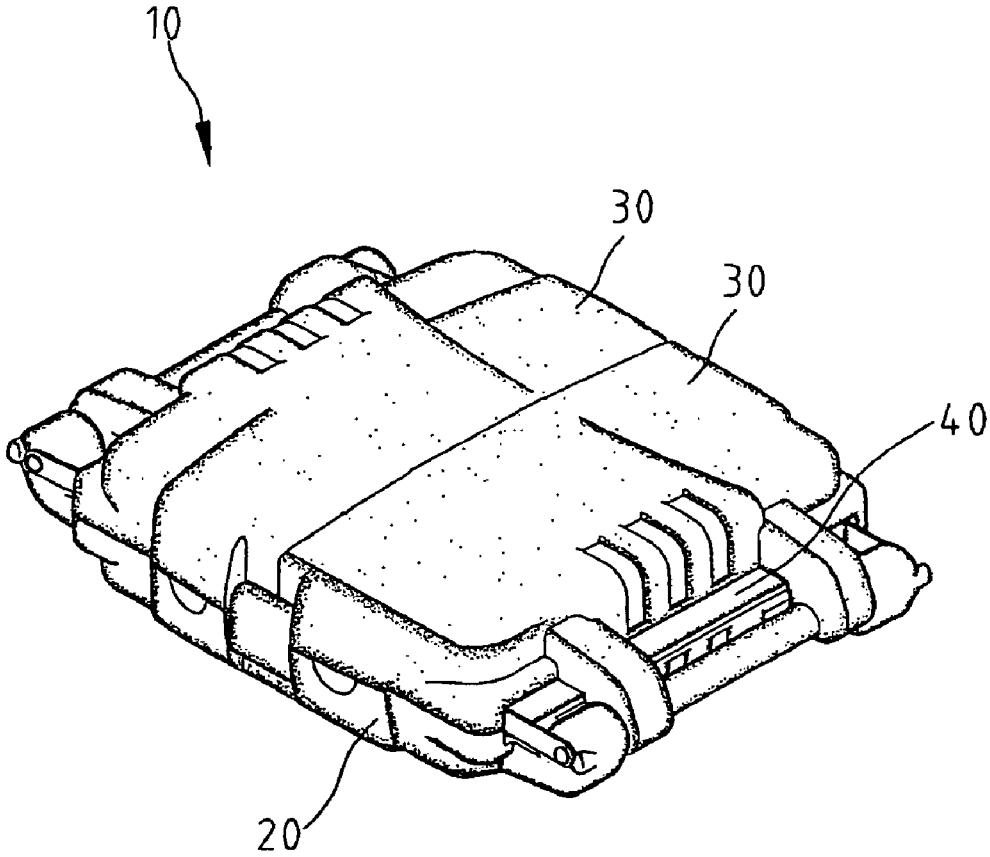
FIG. 1 is a perspective view of a toolbox according to the first embodiment of the present invention.

Referring to FIG. 1, according to a first embodiment of the present invention, a toolbox 10 includes a base 20, two trays 40 and two covers 30. Each tray 40 is pivotally connected with the base 20. Each cover 30 is pivotally connected with the base 20.

Figure 2:
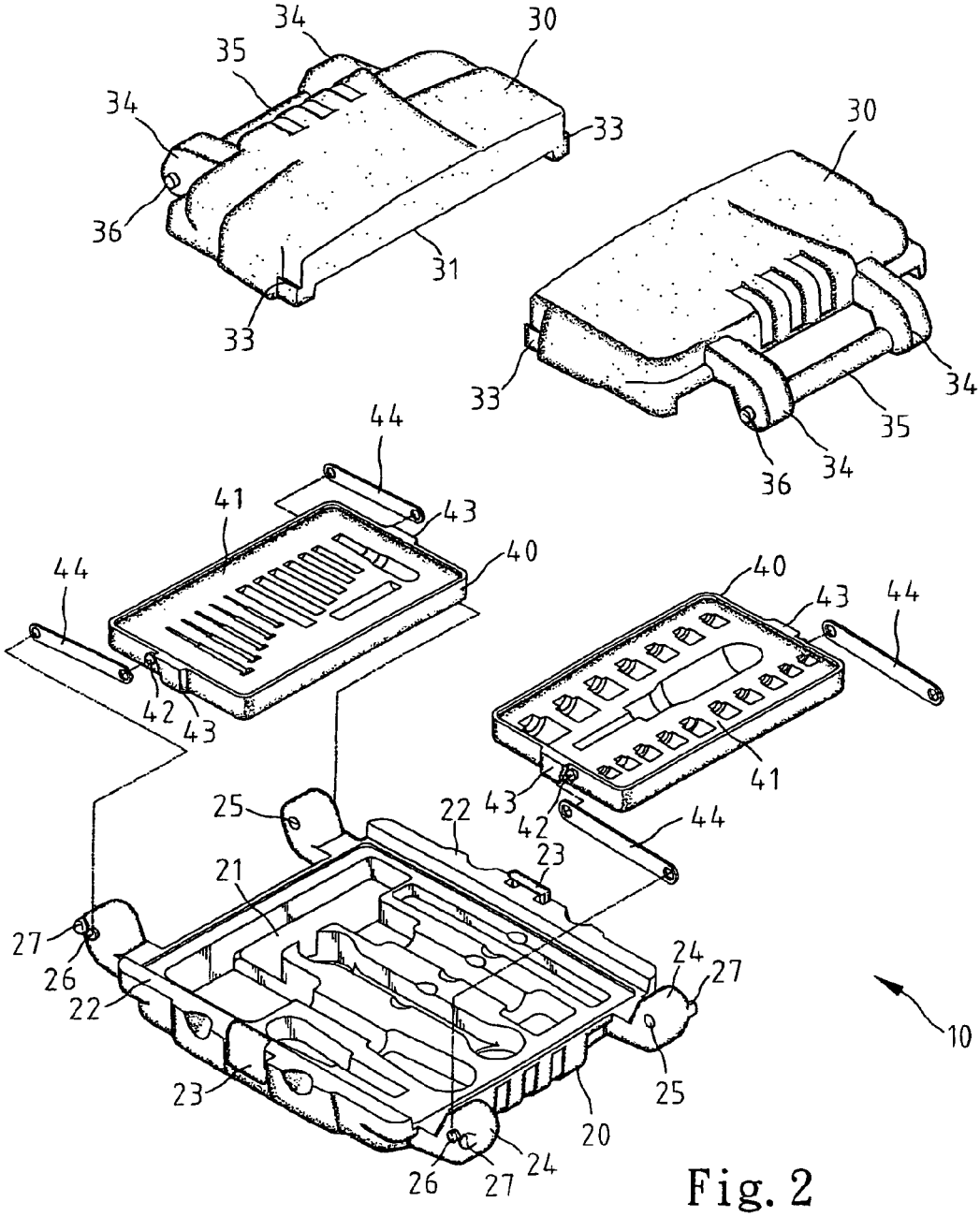
FIG. 2 is an exploded view of the toolbox shown in FIG. 1.
Figure 3:
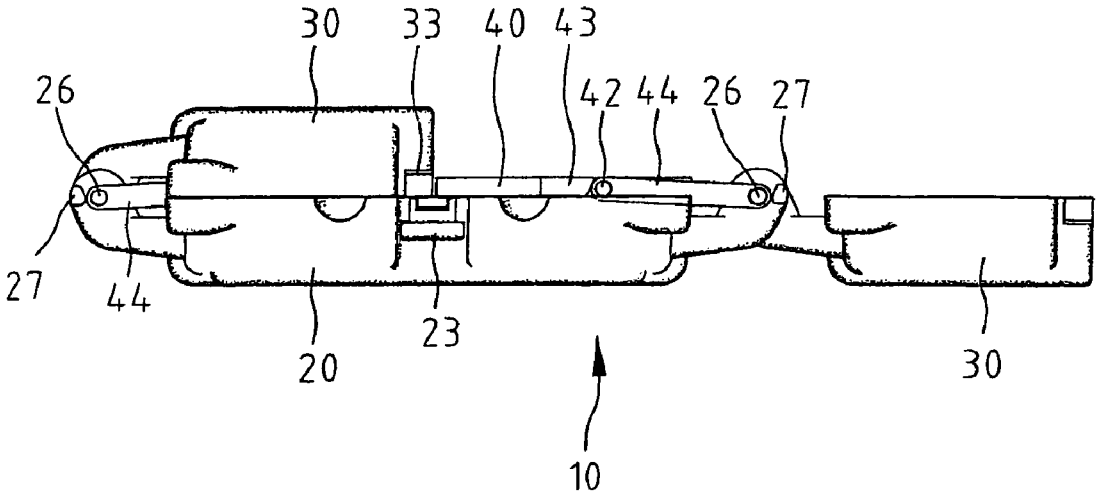
FIG. 3 is a side view of the toolbox shown in FIG. 1.

Referring to FIG. 2, the base 20 defines a plurality of recesses 21 in which tools and parts can be fit. The base 20 includes two high edges 22 and two low edges (not numbered). A buckle 23 is formed on each high edge 22. Two ears 24 are formed on each low edge. A bore 25 is defined in an internal side of each ear 24. A boss 26 is formed on an external side of each ear 24. Each boss 26 includes an enlarged head. A restraint 27 is formed on the external side of each ear 24 near a related boss 26.

Each tray 40 defines a plurality of recesses 41 in which tools and parts can be fit. Each tray 40 includes two bosses 42 formed thereon and two restraints 43 formed thereon near the bosses 42. Each boss 42 includes an enlarged head.

Each tray 40 is pivotally connected with the base 20 by two links 44. Each link 44 defines an aperture (not numbered) at an end for receiving each boss 42 and an aperture (not numbered) at an opposite end for receiving a related boss 26. Thus, each tray 40 is connected with the base 20.

Figure 4:
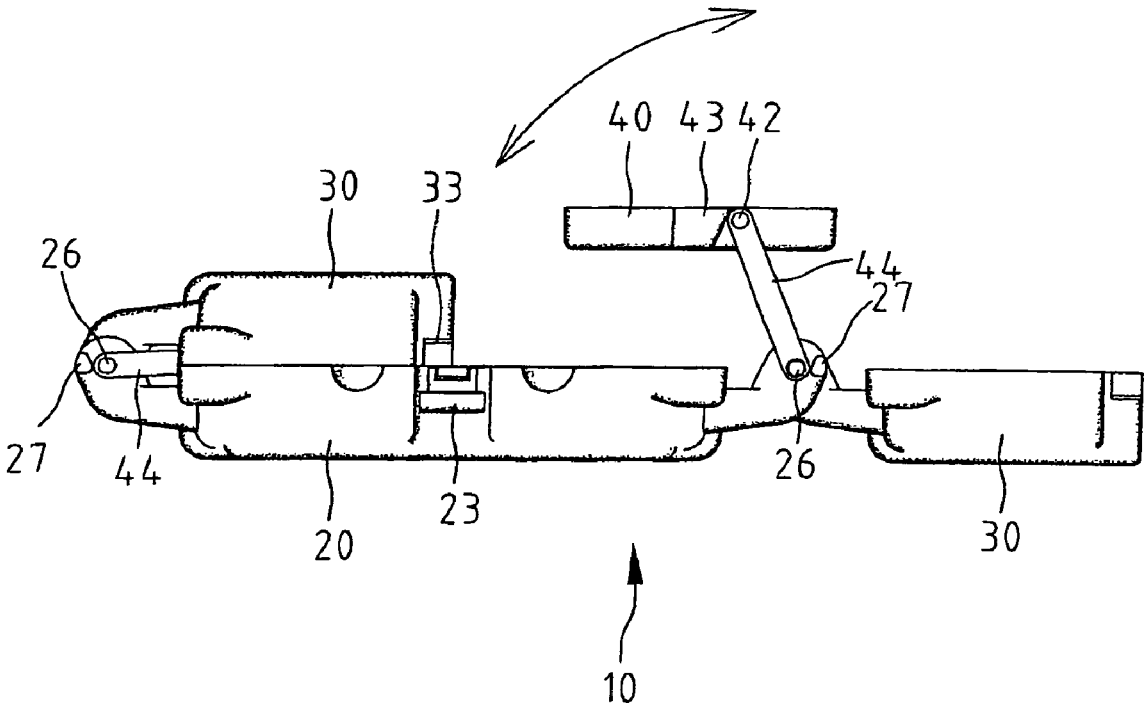
FIG. 4 is similar to FIG. 3 but shows the toolbox in another position.
Figure 5:
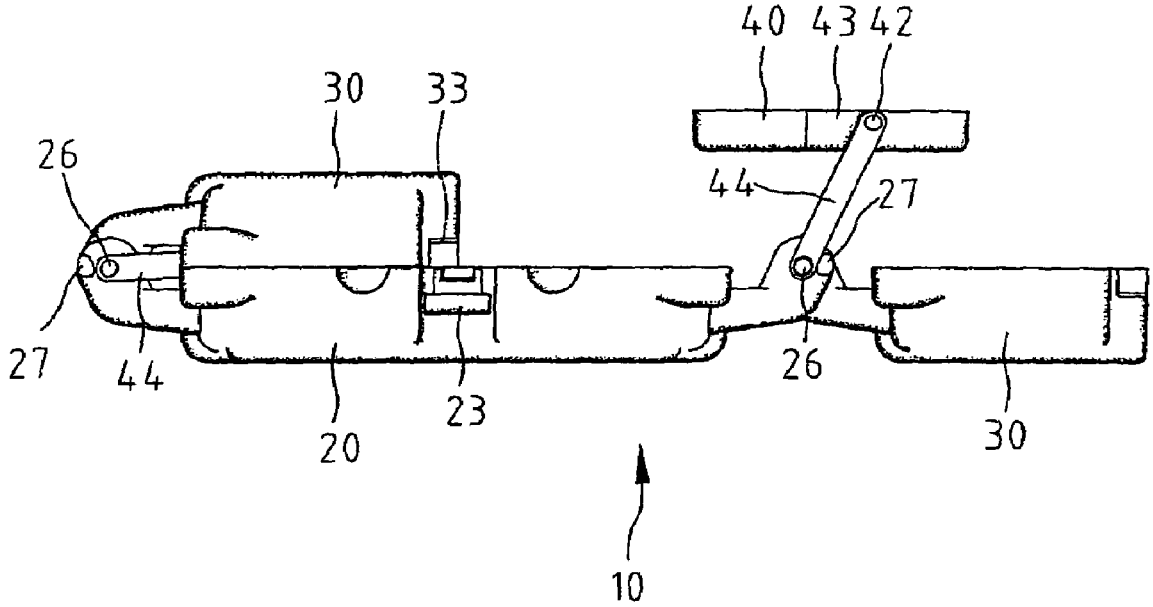
FIG. 5 is similar to FIG. 4 but shows the toolbox in another position.
Figure 6:
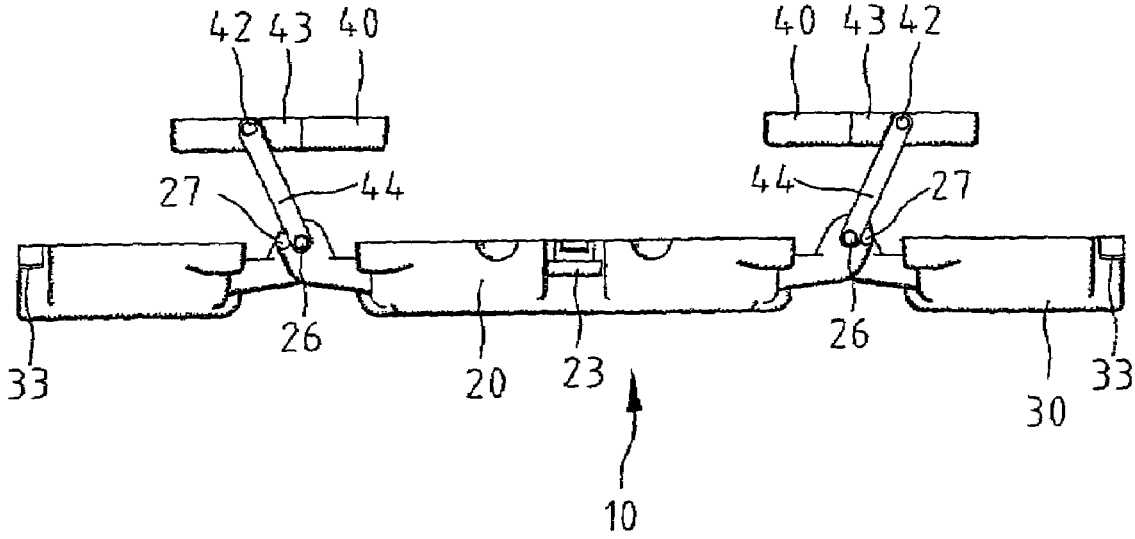
FIG. 6 is similar to FIG. 5 but shows the toolbox in another position.
Figure 7:
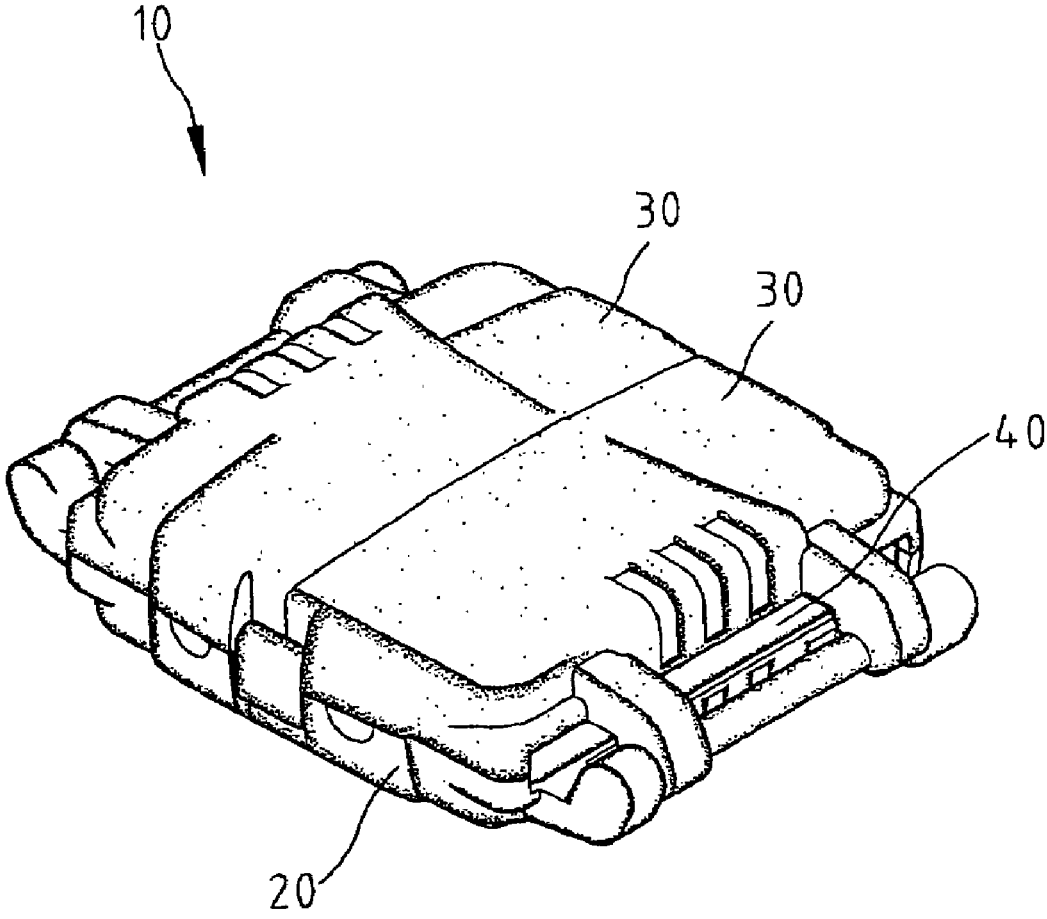
FIG. 7 is a perspective view of a toolbox according to the second embodiment of the present invention.
Figure 8:
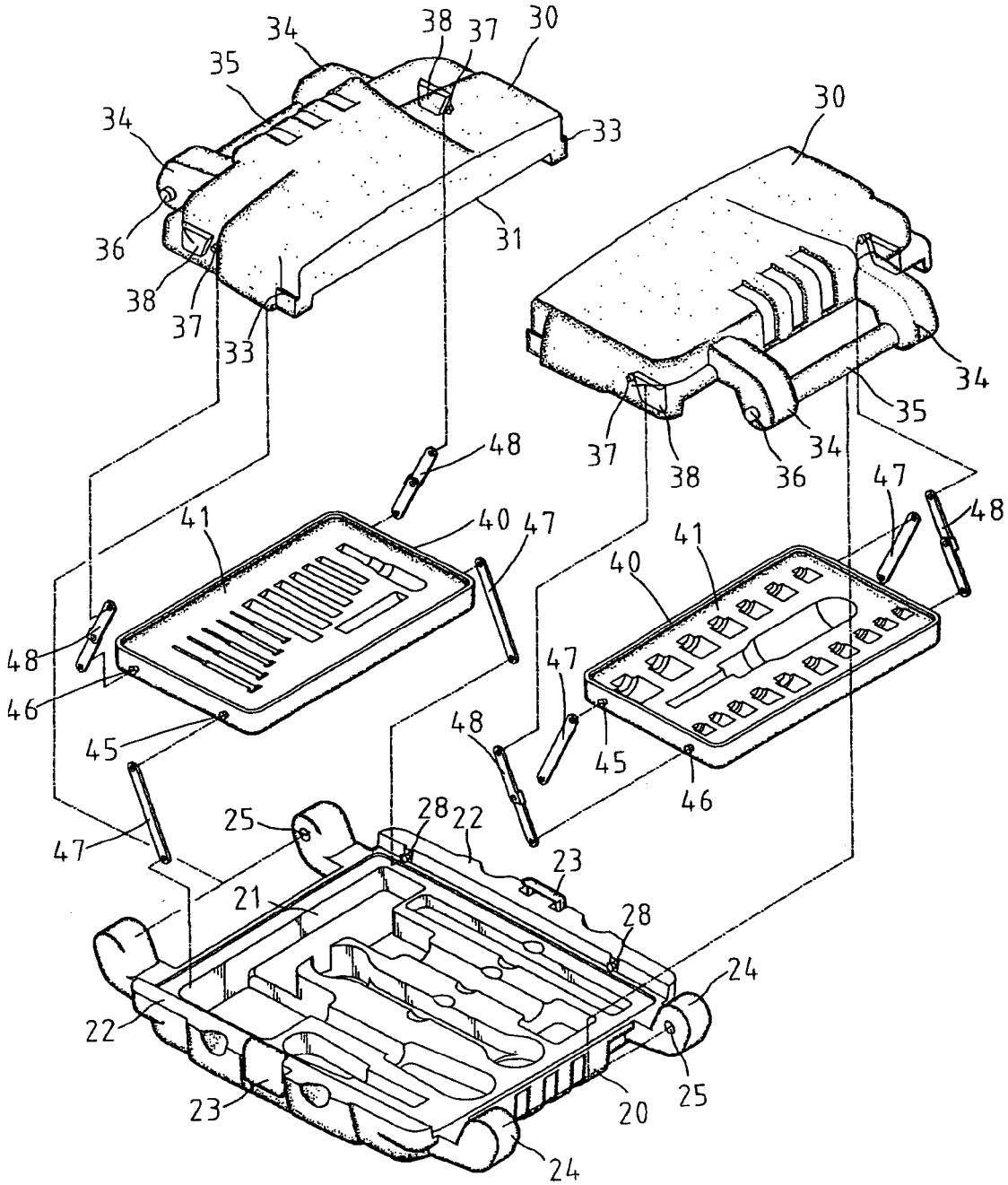
FIG. 8 is an exploded view of the toolbox shown in FIG. 7.
Figure 9:
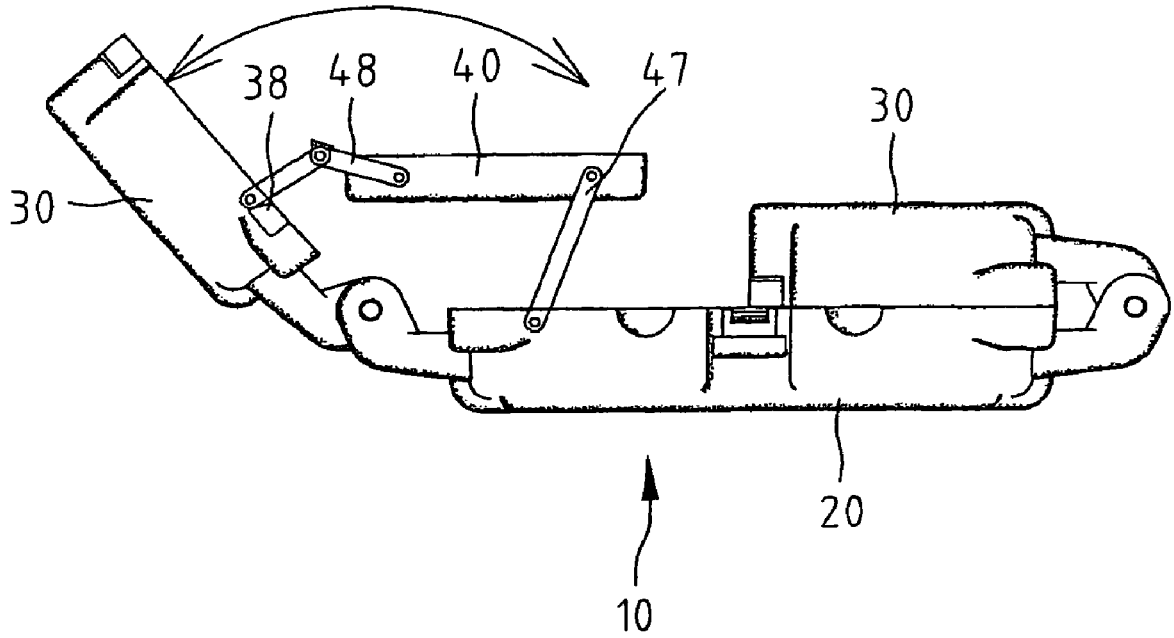
FIG. 9 is a side view of the toolbox shown in FIG. 7.
Figure 10:
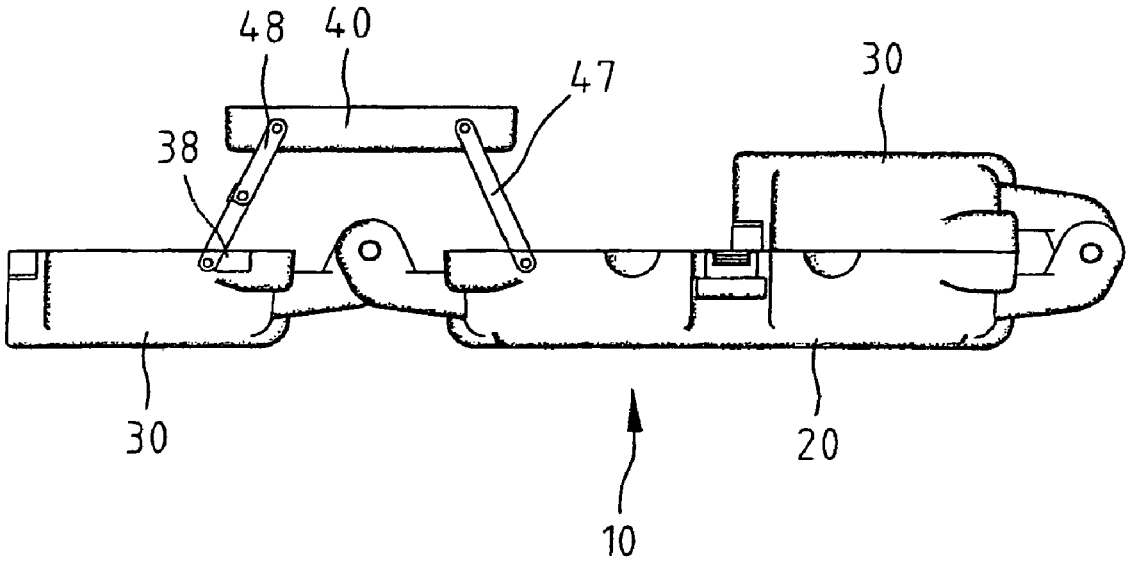
FIG. 10 is similar to FIG. 9 but shows the toolbox in another position.
Figure 11:
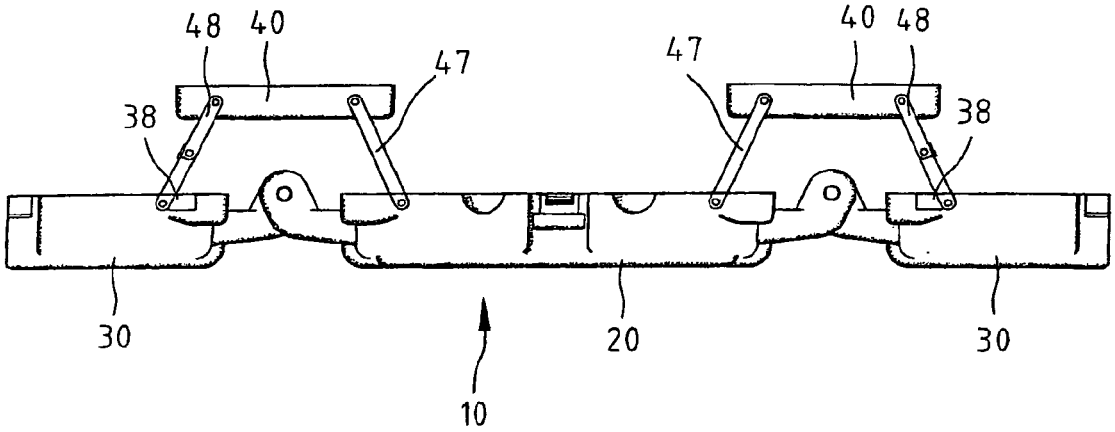
FIG. 11 is similar to FIG. 10 but shows the toolbox in another position.

Referring to FIG. 1, the toolbox 10 is closed. The links 44 are put in the toolbox 10. Although not shown, the trays 40 are put on the base 20 between the high edges 22 as the toolbox 10 is closed. Each tray 40 can be moved to the position shown in FIG. 5 through the position shown in FIG. 4. Each tray 40 is kept in the position shown in FIG. 5 as each link 44 is restrained by the restraints 43 at an end and restrained by the restraints 27 at an opposite end. Referring to FIG. 6, tools and parts can conveniently be put onto or taken from both trays 40. Moreover, as the trays 40 are lifted from the base 20 by an adequate distance, tools and parts can conveniently be put onto or taken from the base 20.

Referring to FIG. 2, each cover 30 includes two buckles 33 corresponding to the buckles 23 of the base 20. The buckles 33 can be engaged with the buckles 23 in order to keep the toolbox 10 closed. Each cover 30 includes two ears 34 formed on an edge, a handle 35 extending between the ears 34 and two bosses 36 each formed on an external side of a related ear 34. Each boss 36 is put in a related bore 25 in order to pivotally connect each cover 30 with the base 20. The covers 30 can be pivoted to the position shown in FIG. 6. The covers 30 are located below the trays 40 so that tools and parts can conveniently be put onto or taken from the trays 40 without being hindered by the covers 30.

FIGS. 7 to 11 show a toolbox 10 according to a second embodiment of the present invention. The second embodiment is identical to the first embodiment except for including two links 47 and two toggles 48 instead of the links 44 and the restraints 43 and 27. Accordingly, each tray 40 includes two bosses 45 each fit in an aperture (not numbered) defined in a related link 47 and two bosses 46 each fit in an aperture (not numbered) defined in a related toggle 48. The base 20 includes two bosses 28 formed on an internal side of each high edge 22 instead of the bosses 26 formed on the ears 24. Each boss 28 is fit in an aperture (not numbered) defined in an opposite end of each link 47. Each cover 30 includes two bosses 37 each fit in an aperture (not numbered) defined in an opposite end of a related toggle 48.

Although not shown, the toggles 48 are folded as the toolbox 10 is closed. Each cover 30 can be pivoted to the position shown in FIG. 10 through the position shown in FIG. 9. Through the toggles 48, the trays 40 are lifted from the base 20. Restraints 38 stop the pivoting of the toggles 48 in order to keep the trays 40 in position. In the position shown in FIG. 11, tools and parts can conveniently be put onto and taken from the base 20 and the trays 30.

The present invention has been described via detailed illustration of two embodiments. Those skilled in the art can derive variations from the embodiments without departing from the scope of the present invention. Therefore, the embodiments shall not limit the scope of the present invention defined in the claims.

What is claimed is:

1. A toolbox comprising:

a base for receiving tools and parts, the base comprising at least one restraint formed on each of two opposite sides;

at least one tray for receiving tools and parts, the tray comprising a restraint formed on each of two opposite sides;

two links pivotally connected with the tray at an end and pivotally connected with the base at an opposite end, wherein the links abut the restraints in order to keep the tray lifted as the toolbox is opened, wherein the tray does not shield the base as it is lifted; and at least one cover pivotally connected with the base, wherein the cover does not shield the tray as the toolbox is opened, wherein the base comprises four ears formed thereon, wherein the cover comprises two ears engaged with the ears of the base, wherein the restraints of the base are formed on the ears of the base.

2. The toolbox according to claim 1 comprising two trays and two covers.

3. The toolbox according to claim 1 wherein the base comprises two edges for shielding the links as the toolbox is closed.

4. The toolbox according to claim 1 wherein each of the ears of the base defines a bore, wherein each of the ears of the cover comprises a boss fit in the bore of each of the ears of the base.

5. The toolbox according to claim 1 wherein the cover comprises a handle extending between the ears thereof.

6. The toolbox according to claim 1 wherein each of the ears of the base comprises two bosses each fit in an aperture defined in related one of the links.

7. The toolbox according to claim 1 wherein the base comprises two buckles, wherein the cover comprises two buckles for engagement with the buckles of the base.

* * * * *